United States Patent [19]

Stoffregen

[11] 4,194,264

[45] Mar. 25, 1980

[54] DOOR CHECK DEVICE

[76] Inventor: Gunter Stoffregen, P.O. Box 488, Coldwater, Ontario, Canada, L0K 1E0

[21] Appl. No.: 928,184

[22] Filed: Jul. 26, 1978

[51] Int. Cl.[2] ..... E05F 3/10; E05F 3/22

[52] U.S. Cl. ..... 16/52; 16/66; 16/84; 16/DIG. 7; 292/278; 292/306; 292/DIG. 4

[58] Field of Search ..... 16/49, 51, 59, 60, 52, 16/61, 66, 70, 65, 82, 141, 84, DIG. 9, DIG. 10, DIG. 17; 292/DIG. 4, 306, 278, 262

[56] References Cited

U.S. PATENT DOCUMENTS

| | | | |
|---|---|---|---|
| 984,594 | 2/1911 | O'Rourke | 292/278 |
| 2,051,969 | 8/1936 | Shastock | 292/306 |
| 2,923,026 | 2/1960 | Nack | 16/49 |
| 3,105,264 | 10/1963 | Truhon | 16/DIG. 9 |
| 3,161,909 | 12/1964 | Strauss | 16/49 X |
| 3,162,889 | 12/1964 | Runnels | 16/66 |
| 3,561,036 | 2/1971 | Crane | 16/49 |
| 3,909,877 | 10/1975 | Christy et al. | 16/49 X |

FOREIGN PATENT DOCUMENTS

| | | | |
|---|---|---|---|
| 22818 | of 1912 | United Kingdom | 16/49 |

*Primary Examiner*—Nile C. Byers, Jr.
*Assistant Examiner*—Moshe I. Cohen

[57] ABSTRACT

A releasable latch, for attachment to a door check unit having a cylinder and a piston, and serving releasably to secure a door in an open position. A lever is freely slidable along the rod of the piston and is tiltable on the rod for releasable locking engagement. A cam and follower are actuable from a pre-set position to tilt the lever into locking engagement when the door is opened beyond a predetermined limit and then released. On release of the lever from locking engagement with the piston rod the cam and follower are returned to their pre-set position.

12 Claims, 7 Drawing Figures

DOOR CHECK DEVICE

FIELD OF THE INVENTION

This invention relates to a releasable latch, for use with a pneumatic or hydraulic door check unit, to hold a door in an open position.

BACKGROUND OF THE INVENTION

Releasable latches presently known allow a door to be held fully open. An example of such a latch is a door check attachment disclosed in applicant's U.S. Pat. No. 3,785,004 issued Jan. 15, 1974. However such devices do not provide an auxiliary mechanism which will enable a door to be held in any selected intermediate or partially open position. Also, the position of the opened door releasably held by the attachment is not readily adjustable.

It is an object of the present invention to provide a releasable latch, attachable to a pneumatic or hydraulic door check unit, which is readily adjustable to hold open a door in a preselected position.

It is a further object of the invention to provide such a latch having an auxiliary mechanism which enables the door to be releasably held in any preselected open position and which is manually operable.

SUMMARY OF THE INVENTION

Essentially the invention consists of a latching device, for attachment to a door check unit having a cylinder and a piston with a piston rod, and serving releasably to secure a door in an open position, comprising: a lever transversely disposable on the piston rod and freely slidable therealong, the lever being tiltable in the plane of the piston rod in one direction for releasable locking engagement therewith; and cam and follower means engaging the lever and actuable from a pre-set position to tilt the lever into locking engagement with the piston rod when the door is opened beyond a predetermined limit and then released, the cam and follower means being returnable to said pre-set position on release of the lever from locking engagement with the piston rod.

An example embodiment of the invention is shown in the accompanying drawings in which:

DETAILED DESCRIPTION

Figures 1, 2, 3:
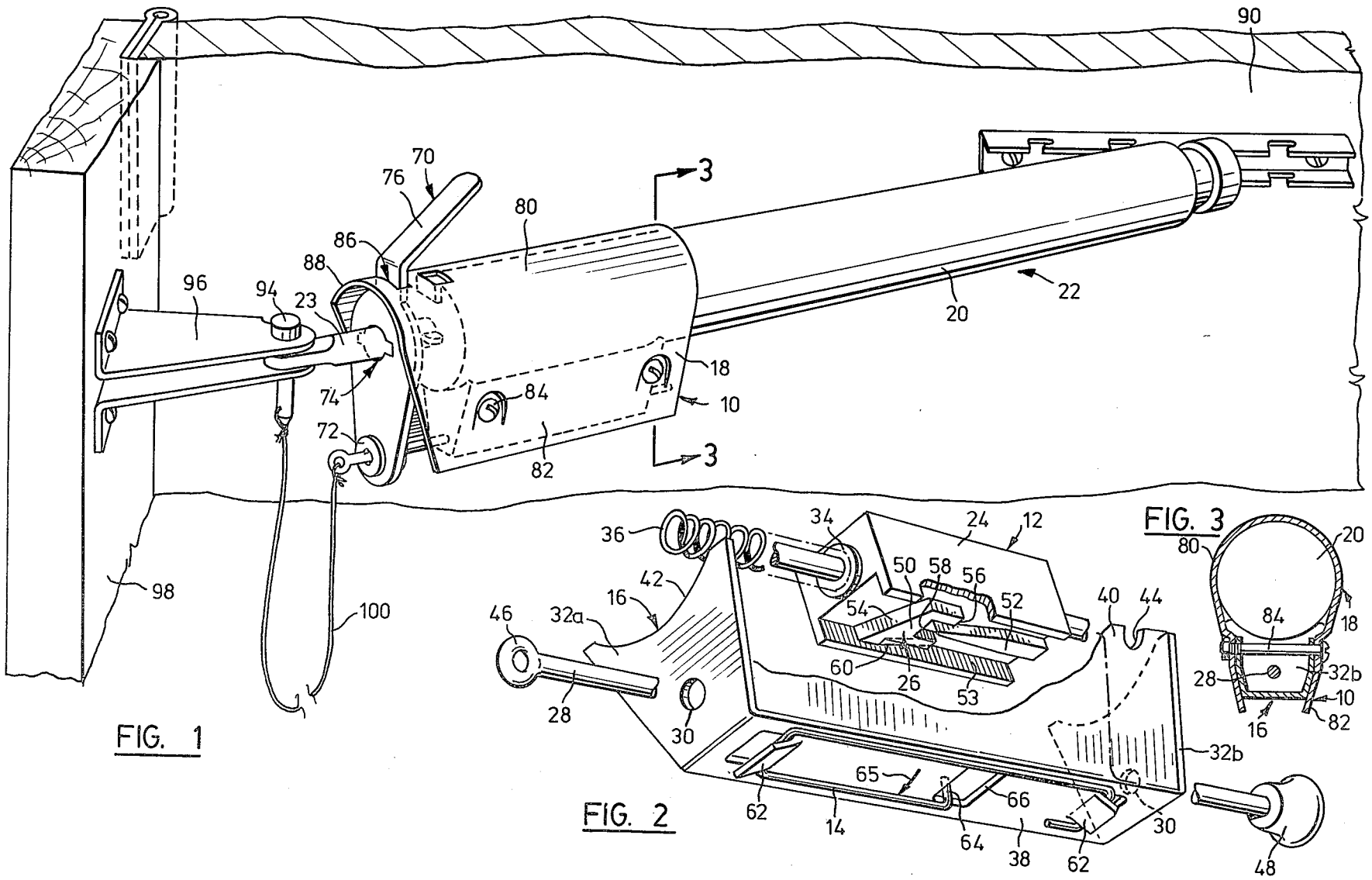
FIG. 1 is a perspective view of a latching device attached to a door check unit which is in turn attached to a door, the door being closed and the latching device being in an inoperative position.
FIG. 2 is an exploded view in perspective showing the cam and follower located within the cowling of the latching device of FIG. 1.
FIG. 3 is a cross-sectioned view of the latching device taken along line 3—3 of FIG. 1.

The example embodiment shown in the drawings consists of a releasable latch 10 having a cam member 12 and a spring member 14 carried by a bracket 16 which is attachable by a cowling 18 to a cylinder 20 of a pneumatic or hydraulic door check unit 22 having a piston rod 23 projecting from the cylinder.

Cam member 12 is in the form of a block 24 having a lower surface recessed with shoulders protruding in the recess to form a cam 26. Block 24 is mounted on an axially reciprocable rod 28 which is slidable in apertures 30 in upstanding end flanges **32*a* and 32*b* of bracket 16. Block 24 is held on rod 28 by washers 34 and is urged away from one end flange 32*a* by a compression spring 36 on the rod. Cam 26 of block 24 faces base 38 of bracket 16 which also has upstanding side walls 40. The upper edges 42 of end flanges 32*a* and 32*b* are each concavely recessed and the upper edge of each side wall 40 has a pair of spaced U-shaped recesses 44. The end of rod 28 protruding from end flange 32*a* has an eye 46 and the end of the rod protruding from end flange 32*b* carries manual gripping means in the form of a knob 48**.

Cam 26 comprises a pair of shoulders 50 and 52 spaced laterally from a pair of parallel side flanges 53. Shoulder 50 has a laterally sloped leading edge 54, a recessed trailing edge 56 having a centrally located recess 58, and an inclined ramp 60 leading from the recessed edge to the forward end of leading edge 54. Shoulder 52 is wedge-shaped and projects into recess 58 of trailing edge 56 of shoulder 50.

Base 38 of bracket 16 carries spring member 14 which is looped to engage a pair of opposed tongues 62 punched out from the base. One free end of spring member 14 is hooked upwardly to form a follower 64 which projects through a slot 66 in base 38 intermediate tongues 62. Spring member 14 lies against the underside of base 38 whereby follower 64 is movable in a direction normal to the plane of the base and laterally with respect to that plane, the spring being biased to lie against the base and normal to the plane of cam 26, and also laterally with respect to the plane of cam 26 in the direction of arrow 65 as seen in FIG. 2.

A release lever 70 engages rod 28 adjacent eye 46 through an aperture in the lower end of the lever and is loosely held from sliding along the rod by a pair of spaced washers 72 fixed to the rod. An aperture 74 is located centrally in the lever and the upper end of the lever terminates in an angled arm 76.

In use, as seen in FIGS. 1 and 3, cowling 18 has a concave upper portion 80 which fits over one end portion of cylinder 20 of door check unit 22 and a pair of opposed lower flanges 82 projecting downwardly from the cylinder with a pair of spaced bolts 84 interconnecting the lower flanges. Bracket 16 is located between flanges 82 of housing 18 with end flanges **32*a* and 32*b* bearing against cylinder 20 and recesses 44 of side walls 40 receiving bolts 84. Thus bracket 16 forms, with cylinder 20, a chamber in which block 24 is slidable parallel to base 38 of the bracket. Arm 76 of lever 70 projects upwardly through a slot 86 in an end portion 88 of cowling 18 projecting over the end of cylinder 20. Piston rod 23 of door check unit 22 passes through aperture 74 of lever 70** whereby the lever is transversely disposed, and slidable along, the piston rod.

Cylinder 20 of door check unit 22 is pivotally connected at one end of a hinged door 90 and piston 23 of the unit is pivotally connected by a pin 94 to a bracket 96 fastened to a wall 98, or vice versa. Limiting means such as a loose chain or cord 100 is connected at one end to pin 94 and at the other end to eye 46 of rod 28.

The operation of the example embodiment is shown diagrammatically in FIGS. 4 to 7 inclusive, block 24 being rotated ninety degrees on rod 28 to illustrate the interaction between cam 26 and follower 64. When door 90 is shut the device assumes the inoperative position shown in FIG. 4 with cord 100 loose, spring 36 partially compressed, and follower 64 resting in recess 58 of cam shoulder 50. In this position lever 70 is normal to piston rod 23.

Figure 5:
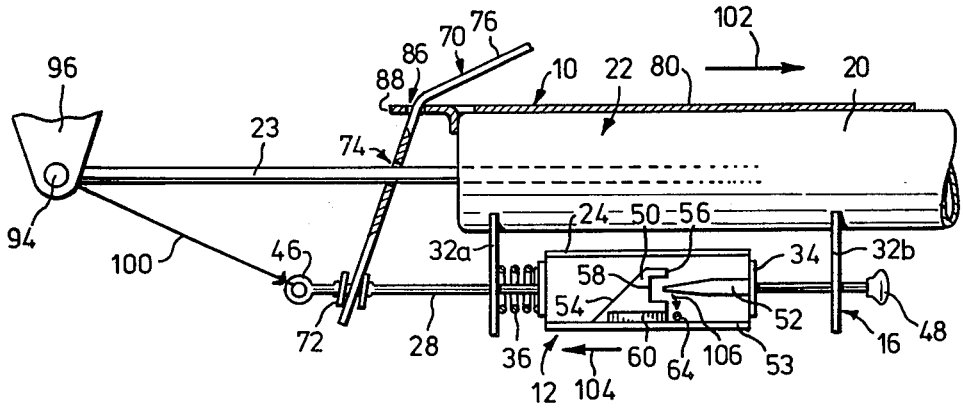
FIG. 5 is a view similar to FIG. 4 showing the latching device triggered by opening the door.

When door 90 is opened, cylinder 20 moves in the direction of arrow 102 as seen in FIG. 5. When cord 100 becomes taut, block 24 is pulled in the direction of arrow 104 within bracket 16 against the action of spring 36 causing follower 64 to move out of recess 58. Because of the configuration of spring member 14, follower 64 is biased to move in the direction of arrow 106 against side flange 53 adjacent ramp 60. During the opening of door 90, lever 70 slides along piston rod 23.

Figure 6:
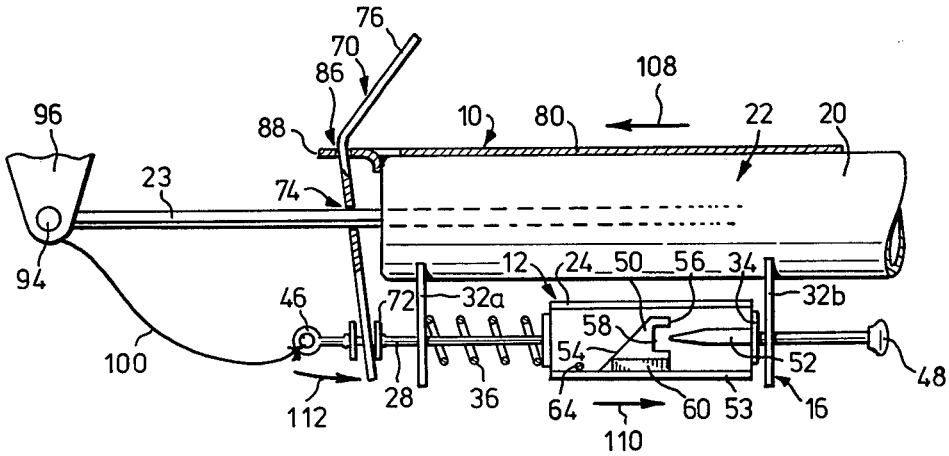
FIG. 6 is a view again similar to FIG. 4 showing the latching device in its operative position holding the door open.

On the release of door 90 to allow it to begin to move towards a re-closed position, cylinder 20 moves in the direction of arrow 108 as seen in FIG. 6, loosening cord 100 and allowing spring 36 to push block 24 in the direction of arrow 110 within bracket 16. As block 24 is moved, follower 64 moves up ramp 60 and beyond leading edge 54 of shoulder 50. At the same time lever 70 is tilted, in the plane of piston rod 23, in the direction of arrow 112 by the movement of rod 28 and locks against piston rod 23 to prevent the door from closing. In this setting, door 90 will be held slightly less than fully open and spring 36 will be relatively uncompressed. However, spring 36 is not fully extended when lever 70 is locked on piston rod 23, thus imparting an additional force on the lever to maintain it in the locked position.

Figure 7:
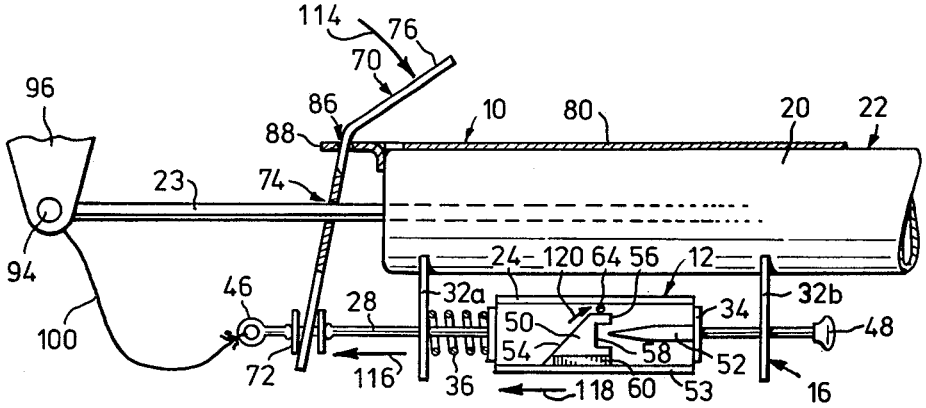
FIG. 7 is a view again similar to FIG. 4 showing the latching device released and showing the door moving towards a closed position.

To release door 90 from the position of FIG. 6 and allow it to close, lever arm 76 is depressed in the direction of arrow 114 as seen in FIG. 7, which releases lever 70 from locking engagement with piston rod 23 and allows the lever to slide along the piston rod, permitting the piston to move in relation to cylinder 20. Also the depression of lever arm 76 moves rod 28 in the direction of arrow 116 to fully depress spring 36 (as in FIG. 5) and move block 34 in the direction of arrow 118, causing follower 64 to move along inclined leading edge 54 of shoulder 52 in the direction of arrow 120. Because of the bias of follower 64 it returns to its position of rest in recess 58 in trailing edge 56 of shoulder 50. Shoulder 52 ensures that follower 64 does not overshoot recess 58 on the return to its position of rest.

Alternatively, door 90 may be released from the open position by opening the door fully, from the slightly less than fully open position of FIG. 6, which will release lever 70 from locking engagement with piston rod 23, as in FIG. 5. As a further alternative, the release of door 90 from the position of FIG. 6 may be effected by pushing knob 48 to move rod 28 and release lever 70 from locking engagement with piston 92.

Figure 4:
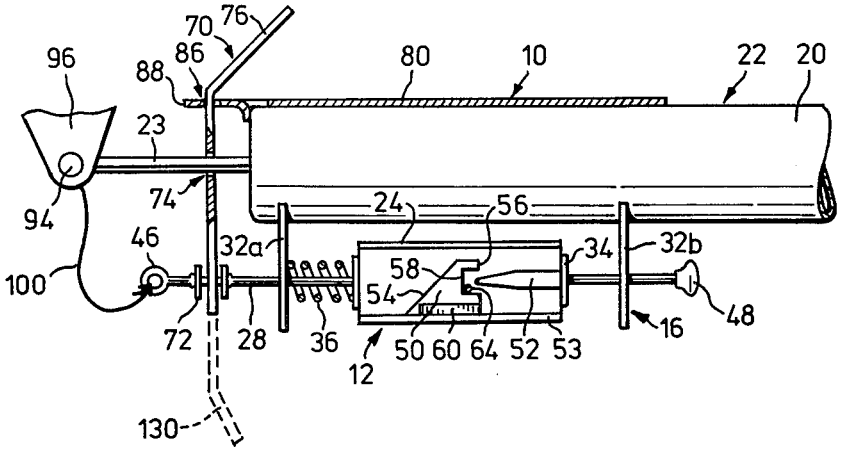
FIG. 4 is a diagrammatic view showing the latching device of FIG. 1 in an inoperative position with the door closed, as in FIG. 1, the view of the cam and follower being rotated 90 degrees for illustrative purposes.

As seen in FIG. 4, lever 70 may extend below rod 28 as indicated by broken lines 130 and be operable from beneath door check unit 22.

I claim:

1. A latching device, for attachment to a door check unit having a cylinder and a piston with a piston rod, and serving releasably to secure a door in an open position, comprising:

a lever transversely disposable on the piston rod and freely slidable therealong, the lever being tiltable in the plane of the piston rod in one direction for releasable locking engagement therewith; and cam and follower means engaging the lever and actuable from pre-set position to tilt the lever into locking engagement with the pistion rod when the door is opened beyond a predetermined limit and then released, the cam and follower means being returnable to said pre-set position on release of the lever from locking engagement with the piston rod.

2. A device as claimed in claim 1 in which the cam and follower means is fixable on the cylinder of the door check unit.

3. A device as claimed in claim 2 in which the cam of the cam and follower means is movable parallel to the cylinder and spring means urges the cam away from the lever to tilt the lever into locking engagement with the lever.

4. A device as claimed in claim 3 including limiting means connecting the cam with the free end of the piston and urging the cam against the action of the spring means when the door is opened beyond said predetermined limit.

5. A device as claimed in claim 4 in which the cam comprises a shoulder having a sloping leading edge and a recessed trailing edge, the follower being located in the recess of the trailing edge when the cam and follower means is in the pre-set position and urging the cam partially to compress the spring means and movable from the recess to the leading edge of the cam when the cam is urged to further compress the spring means and then released.

6. A device as claimed in claim 3 in which the cam and follower means and the spring means are mounted on an axially reciprocable rod, the lever being connected to the rod and tiltable thereby.

7. A device as claimed in claim 6 in which a cowling fixed to the cylinder extends over the end thereof and the lever extends through a slot in the cowling to form a manually operable arm.

8. A device as claimed in claim 7 in which the axially reciprocable rod is slidable in a bracket fixed to the cylinder by the cowling.

9. A device as claimed in claim 6 in which the lever extends beyond the axially reciprocable rod to form a manually operable arm.

10. A device as claimed in claim 6 in which the axially reciprocable rod terminates in manual gripping means.

11. A device as claimed in claim 8 in which the spring member is carried by the bracket, one end of the spring member being hooked to form the follower, the spring member biasing the follower laterally and normally with respect to the plane of the cam.

12. A device as claimed in claim 11 in which the cam shoulder includes a ramp up which the follower travels in moving from the trailing edge to the leading edge thereof.

* * * * *